US009540204B2

(12) United States Patent
Michibata et al.

(10) Patent No.: US 9,540,204 B2
(45) Date of Patent: Jan. 10, 2017

(54) SHEET DISCHARGE APPARATUS AND IMAGE FORMING APPARATUS

(71) Applicant: KONICA MINOLTA, INC., Chiyoda-ku, Tokyo (JP)

(72) Inventors: Takumi Michibata, Toyokawa (JP); Takao Shibazaki, Toyokawa (JP); Hideyuki Nukumi, Aichi-ken (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/555,127

(22) Filed: Nov. 26, 2014

(65) Prior Publication Data

US 2015/0153699 A1 Jun. 4, 2015

(30) Foreign Application Priority Data

Dec. 2, 2013 (JP) ..... 2013-248804

(51) Int. Cl.

| | |
|---|---|
| ***B65H 29/12*** | (2006.01) |
| ***B65H 29/70*** | (2006.01) |
| *G03G 15/00* | (2006.01) |
| *B65H 29/14* | (2006.01) |
| *B65H 29/22* | (2006.01) |

(52) U.S. Cl.

CPC ..... *B65H 29/125* (2013.01); *B65H 29/70* (2013.01); *B65H 29/14* (2013.01); *B65H 29/22* (2013.01); *B65H 2404/14* (2013.01); *B65H 2404/694* (2013.01); *B65H 2404/6942* (2013.01); *G03G 15/6552* (2013.01); *G03G 2215/0132* (2013.01)

(58) Field of Classification Search

CPC ..... B65H 5/062; B65H 5/068; B65H 29/125; B65H 29/70; B65H 2404/656; B65H 2404/694; B65H 29/22; B65H 2404/6942; G03G 15/6552

USPC ..... 271/188, 209

See application file for complete search history.

(56) References Cited

U.S. PATENT DOCUMENTS 5,249,793 A * 10/1993 Scheufler ..... B65H 29/14 271/188
5,527,123 A * 6/1996 Jackson et al. ..... 400/642
2002/0038936 A1 4/2002 Fujisawa et al.

FOREIGN PATENT DOCUMENTS

| | | | |
|---|---|---|---|
| JP | 09188458 | A | 7/1997 |
| JP | 2002114423 | A | 4/2002 |
| JP | 2005263335 | A | 9/2005 |
| JP | 2005263418 | A | 9/2005 |

OTHER PUBLICATIONS

Japanese Office Action (and English translation thereof) dated Sep. 15, 2015, issued in counterpart Japanese Application No. 2013-248804.

* cited by examiner

*Primary Examiner* — Michael McCullough
(74) *Attorney, Agent, or Firm* — Holtz, Holtz & Volek PC

(57) ABSTRACT

A sheet is discharged from between a discharge roller and a feeding roller as pinched between the rotating discharge roller and feeding roller. In this arrangement, a guide is arranged from an upstream side to a downstream side in a sheet discharge direction. The guide is arranged to contact the discharge roller at a downstream position in the discharge direction from a position where the discharge roller contacts the feeding roller.

20 Claims, 5 Drawing Sheets

SHEET DISCHARGE APPARATUS AND IMAGE FORMING APPARATUS

RELATED APPLICATION

The priority application Number Japanese Patent Application 2013-248804 upon which this application is based is hereby incorporated by reference.

BACKGROUND OF THE INVENTION

Field of the Invention

The present invention relates to a sheet discharge apparatus for discharging a sheet from between a discharge roller and a feeding roller as well as to an image forming apparatus, such as copiers, printers, facsimiles and machines with multi-functional peripherals, which employs such a sheet discharge apparatus.

Description of the Related Art

In the image forming apparatus such as copiers, printers, facsimiles and machines with multi-functional peripherals, the sheet discharge apparatus is used for sequentially discharging sheets with toner images formed thereon to a sheet delivery portion.

The sheet discharge apparatus commonly operates as follows to sequentially discharge the sheets with toner images formed thereon to the sheet delivery portion. The sheet with the toner image formed thereon is guided into nip between the discharge roller and the feeding roller. With this sheet pinched between roller portions of the discharge roller and roller portions of the feeding roller, the discharge roller and the feeding roller are rotated to discharge the sheet from between the discharge roller and the feeding roller.

In the case where the sheet is discharged from between the discharge roller and the feeding roller in this manner, resistance is applied to the discharged sheet because the sheet is discharged from between the discharge roller and the feeding roller while making contact with an upper surface of the sheet delivery portion or the sheet already discharged.

In a case where a sheet having high frictional resistance, a sheet elongated in a sheet discharge direction, or a sheet curled during thermal fixing of the toner image or the like is discharged, or where a sheet is discharged at low velocity, a trailing end of the discharged sheet may sometimes remain on the roller portions of the feeding roller so that the sheet is not properly discharged from between the discharge roller and the feeding roller onto the sheet delivery portion.

If the trailing end of the discharged sheet remains on the roller portions of the feeding roller, the following problem may occur. When the next sheet is discharged from between the discharge roller and the feeding roller, the preceding sheet remaining on the roller portions of the feeding roller may become an obstacle to the discharge of the next sheet, which is not discharged but gets jammed. Otherwise, the preceding sheet remaining on the roller portions of the feeding roller may be pushed out significantly by the next sheet discharged, thus significantly displaced from a discharge position. Otherwise, the next sheet may get under the preceding sheet remaining on the roller portions of the feeding roller, causing the collapse of the order of discharged sheets.

In this connection, Patent Document 1 (Japanese Unexamined Patent Publication No. 2002-114423) has heretofore proposed an arrangement where a pressing member is rotatably arranged in a manner to block a sheet discharge path for a sheet discharged from between the discharge roller and the feeding roller. This pressing member is pushed up by the sheet discharged from between the discharge roller and the feeding roller so as to allow the sheet to be discharged to the sheet delivery portion. Further, the pressing member presses down the trailing end of the sheet passed through between the discharge roller and the feeding roller so as to separate the trailing end of the sheet from the feeding roller.

However, in the case where the pressing member is rotatably arranged to block the sheet discharge path such that the pressing member is pushed up by the sheet discharged from between the discharge roller and the feeding roller, a problem exists that a sheet weak in stiffness has difficulty in adequately pushing up the pressing member so as to get jammed at this pressing member. On the other hand, in a case where the above-described pressing member is adapted to be easily pushed up by the discharged sheet, a problem exists that this pressing member is incapable of adequately pressing down the trailing end of the sheet passed through between the discharge roller and the feeding roller. It is difficult for the pressing member to adequately separate the trailing end of the sheet from the feeding roller.

Further, Patent Document 2 (Japanese Unexamined Patent Publication No. 2005-263335) has heretofore proposed an arrangement which employs a pressing member including first and second arms. The sheet transported through between a first pair of discharge rollers rotates the pressing member to retract down the first arm of the pressing member. The sheet is moved over the first arm thus retracted and guided in between a second pair of discharge rollers on a downstream side. This sheet is discharged from between the second pair of discharge rollers to the sheet delivery portion outside an image forming apparatus. In the meantime, the second arm of the rotatable pressing member is rotated toward the outside of the image forming apparatus so that this second arm presses down the trailing end of the sheet discharged to the sheet delivery portion outside the image forming apparatus.

However, the arrangement disclosed in Patent Document 2 also has the problem that since the sheet transported through between the first pair of discharge rollers rotates the pressing member so as to retract down the first arm of the pressing member, as described above, the sheet weak in stiffness has difficulty in adequately rotating the pressing member, getting jammed at this first arm. Further, in the arrangement disclosed in Patent Document 2, the second arm of the pressing member is simply arranged to press down the trailing end of the sheet discharged to the sheet delivery portion outside the image forming apparatus. In the case of a sheet with the trailing end remaining in between the second pair of discharge rollers, therefore, it is also difficult for the second arm to adequately separate this sheet from between the second pair of discharge rollers.

SUMMARY OF THE INVENTION

A sheet discharge apparatus according to one aspect of the invention includes:

- a discharge roller;
- a feeding roller that is arranged to oppose the discharge roller, the discharge roller and the feeding roller arranged to pinch a sheet therebetween and to discharge the sheet by rotation; and
- a guide that is arranged from an upstream side to a downstream side in a discharge direction of the sheet and contacts the discharge roller at a downstream position in the discharge direction from a position where the discharge roller contacts the feeding roller.

An image forming apparatus according to one aspect of the invention employs the above sheet discharge apparatus as a sheet discharge apparatus for discharging a sheet with toner image formed thereon to a sheet delivery portion.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

Figure 1:
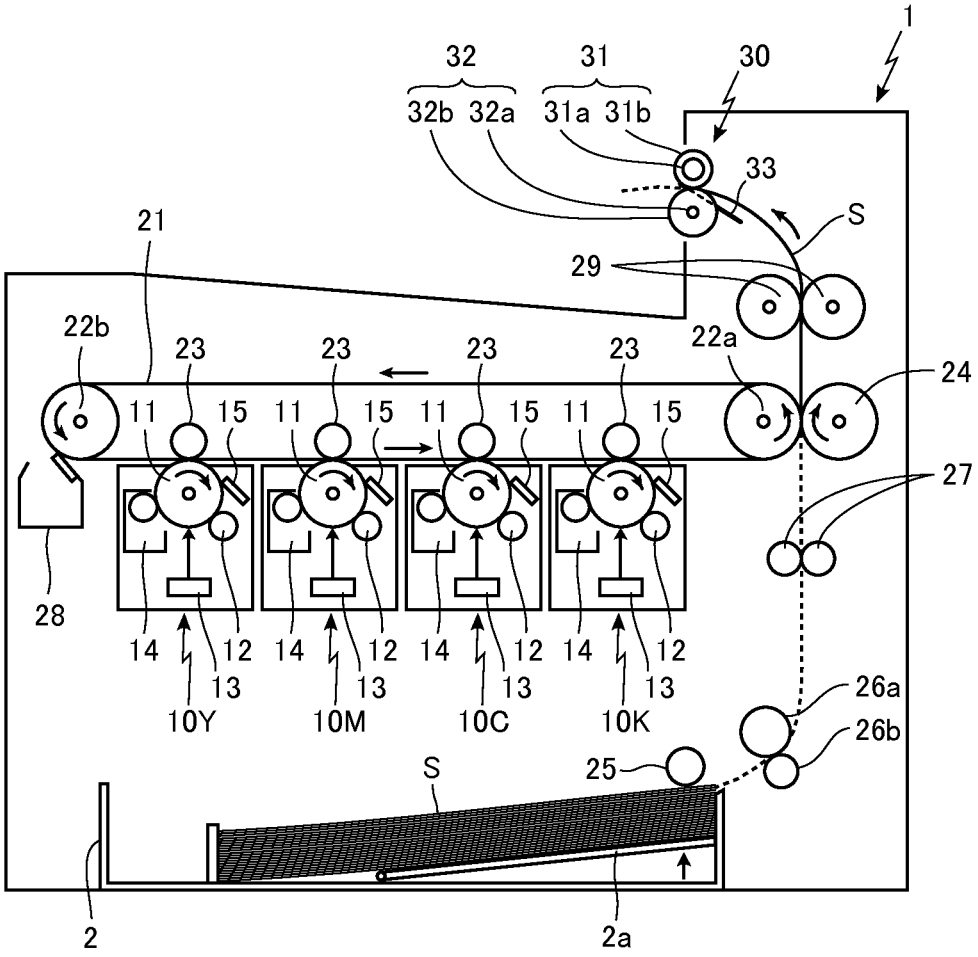
FIG. 1 is a schematic explanatory diagram of an image forming apparatus and a sheet discharge apparatus according to an embodiment of the invention, showing a state where a toner image is formed on a sheet and the sheet with the toner image formed thereon is discharged to a sheet delivery portion by a sheet discharge apparatus.

In a sheet discharge apparatus according to the invention, a sheet is pinched between a discharge roller and a feeding roller arranged to oppose this discharge roller. The sheet is discharged from between the discharge roller and the feeding roller by rotating the discharge roller and feeding roller. In this arrangement, a guide that is arranged from an upstream side to a downstream side in a sheet discharge direction is arranged to contact the discharge roller at a downstream position in the discharge direction from a position where the discharge roller contacts the feeding roller.

If the guide that is arranged from the upstream side to the downstream side in the sheet discharge direction is arranged to contact the discharge roller at the downstream position in the sheet discharge direction from the position where the feeding roller contacts the discharge roller, the following effect is obtained. Even though a trailing end of the sheet transported by the rotation of the discharge roller and the feeding roller moves through the contact position between the discharge roller and the feeding roller, the sheet is further moved by the discharge roller along the guide to a downstream position in the sheet discharge direction where the guide contacts roller portions of the discharge roller, so that the sheet is discharged through nip where this guide contacts the discharge roller.

Accordingly, the above-described sheet discharge apparatus does not encounter the problem that the trailing end of the sheet remains on the feeding roller, constituting the obstacle to the discharge of the next sheet through nip between the discharge roller and the feeding roller. In the above-described sheet discharge apparatus, therefore, the following problems are adequately prevented. Namely, the next sheet is not discharged but gets jammed. The preceding sheet remaining on the feeding roller is pushed out significantly by the next sheet being discharged, thus significantly displaced from the discharge position. Otherwise, the next sheet gets under the preceding sheet remaining on the feeding roller, causing the collapse of the order of discharged sheets.

If the above-described sheet discharge apparatus has the arrangement where the downstream end of the guide in the discharge direction is allowed to contact the above-described discharge roller at the downstream position in the discharge direction from the contact position between the discharge roller and the feeding roller, the trailing end of the sheet transported by the discharge roller to the downstream position in the discharge direction where the guide contacts the discharge roller is smoothly discharged from the downstream end of the guide in the discharge direction. Thus is eliminated a problem that the trailing end of the sheet remains on the guide.

A member formed of an elastic material may be used as the above-described guide. This guide can be pressed against the roller portions of the discharge roller.

The discharge roller and the feeding roller are vertically arranged one above the other to allow the feeding roller to contact a lower side of the discharge roller, while the guide is arranged to contact the roller portions of the discharge roller at the downstream position in the discharge direction from the position where the feeding roller contacts the discharge roller. It is preferred in this arrangement that the horizontal distance 'b' between the position of shaft center of the feeding roller and the position where the guide contacts the discharge roller satisfies a condition:

$$b > r - v \cdot (2a/g)^{1/2},$$

where 'r' denotes the radius of the feeding roller; 'a' denotes the vertical distance between the position of shaft center of the feeding roller and the contact position between the guide and the discharge roller; 'b' denotes the horizontal distance between the position of shaft center of the feeding roller and the contact position between the guide and the discharge roller; 'v' denotes the velocity at which the discharge roller discharges the sheet; and 'g' denotes the acceleration due to gravity.

It is noted here that if the arrangement is made to satisfy the above condition, the trailing end of the sheet discharged from the contact position between the guide and the discharge roller at the predetermined sheet discharge velocity is properly discharged as moved beyond the roller portions of the feeding roller.

An image forming apparatus according to the invention employs the above-described sheet discharge apparatus as a sheet discharge apparatus for discharging the sheet with toner image formed thereon to a sheet delivery portion.

Therefore, the image forming apparatus is capable of properly discharging the sheets with toner images formed thereon to the sheet delivery portion in sequence.

Next, a sheet discharge apparatus according to an embodiment of the invention and an image forming apparatus employing such a sheet discharge apparatus will be specifically described with reference to the accompanying drawings. It is to be noted that the sheet discharge apparatus and the image forming apparatus according to the invention are not limited to the following embodiments but the invention can be appropriately carried out in various ways without departing from the spirit or essential characteristics thereof.

As shown in FIG. 1, an image forming apparatus 1 according to the embodiment incorporates therein four imaging units 10K, 10C, 10M, 10Y which include: a black imaging unit 10K performing image formation using a black toner, acyan imaging unit 10C performing image format ion using a cyan toner, a magenta imaging unit 10M performing image formation using a magenta toner and a yellow imaging unit performing image formation using a yellow toner.

Each of the above-described imaging units 10K, 10C, 10M, 10Y is provided with: a photoreceptor 11; a charger unit 12 for electrically charging a surface of this photoreceptor 11; a latent image forming unit 13 for forming an electrostatic latent image on the surface of the photoreceptor 11 by exposing the charged surface of the photoreceptor 11 to light according to image information; a developing unit 14 for forming a toner image by supplying toner to the electrostatic latent image formed on the surface of the photoreceptor 11; and a first cleaning unit 15 for removing residues such as the toner remaining on the surface of the photoreceptor after transfer of the toner image formed on the photoreceptor surface 11 to an intermediate transfer belt 21 to be described hereinlater.

In the respective imaging cartridges 10K, 10C, 10M, 10Y of this image forming apparatus 1, the toner images of the respective colors are formed on the respective photoreceptor surfaces 11 by performing the steps of: electrically charging the respective surfaces of the photoreceptors 11 by means of the respective charger units 12; exposing the respective charged surfaces of the photoreceptors 11 to light according to the image information by means of the respective latent image forming units 13 so as to form the respective electrostatic latent images on the photoreceptor surfaces 11 according to the image information; supplying the toners of the respective colors to the electrostatic latent images on the respective surfaces of the photoreceptors 11 by means of the respective developing units 14 so as to form the toner images of the respective colors on the respective surfaces of the photoreceptors 11.

Subsequently, the respective photoreceptors 11 of the imaging units 10K, 10C, 10M, 10Y carry the toner images formed thereon in the respective colors to respective primary transfer rollers 23 opposed thereto via an intermediate transfer belt 21 entrained between a driving roller 22*a* and a rotary roller 22*b* and rotatably driven. The toner images formed in the respective colors on the respective photoreceptor surfaces 11 are sequentially transferred to the intermediate transfer belt 21 by means of the respective primary transfer rollers 23 whereby the toner images of the respective colors are superimposed on each other on this intermediate transfer belt 21. After the toner images formed on the respective photoreceptor surfaces 11 are primarily transferred to the intermediate transfer belt 21 as described above, the residues such as the toners remaining on the respective photoreceptor surfaces 11 are removed by the respective first cleaning units 15.

Subsequently, the toner images of the respective colors superimposed on the intermediate transfer belt are carried to a position opposite a secondary transfer roller 24.

On the other hand, a paper cassette 2 storing stacked sheets S therein is disposed in this image forming apparatus 1 at a bottom thereof. The sheets S stored in this paper cassette 2 are pushed up by a pushup plate 2*a* while a pickup roller 25 picks up one of the pushed-up sheets S from the paper cassette 2 and feeds the sheet to nip between a paper feed roller 26*a* and a separation roller 26*b*. The paper feed roller 26*a* and the separation roller 26*b* move the one sheet S through nip therebetween so as to feed the sheet S to nip between a pair of timing rollers 27. This timing roller pair 27 feeds the sheet S to nip between the above-described intermediate transfer belt 21 and secondary transfer roller 24 in a proper timing such that the above-described toner image formed on the intermediate transfer belt 21 may be transferred to the sheet S by the secondary transfer roller 24. It is noted that the residues such as the toners un-transferred to the sheet S and remaining on the intermediate transfer belt 21 are removed from the intermediate transfer belt 21 by means of a second cleaning unit 28.

Subsequently, the sheet S with the toner image transferred thereto as described above is fed to a fixing unit 29 by which the above-described toner image is fixed to the sheet S. Subsequently, the sheet S with the toner image fixed thereto is discharged to a sheet delivery portion 3 by means of a sheet discharge apparatus 30.

Figure 2:
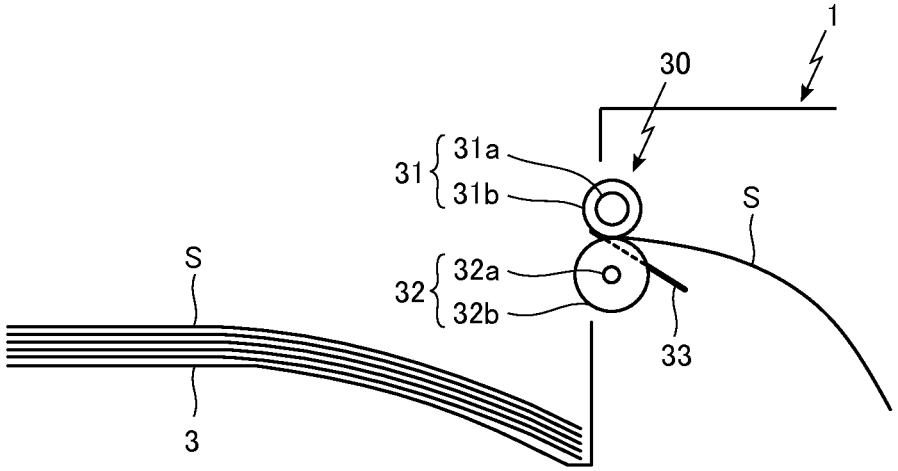
FIG. 2 is a fragmentary explanatory diagram showing a state where the sheet with the toner image formed thereon is discharged to the sheet delivery portion by the sheet discharge apparatus according to the above embodiment of the invention.
Figure 3:
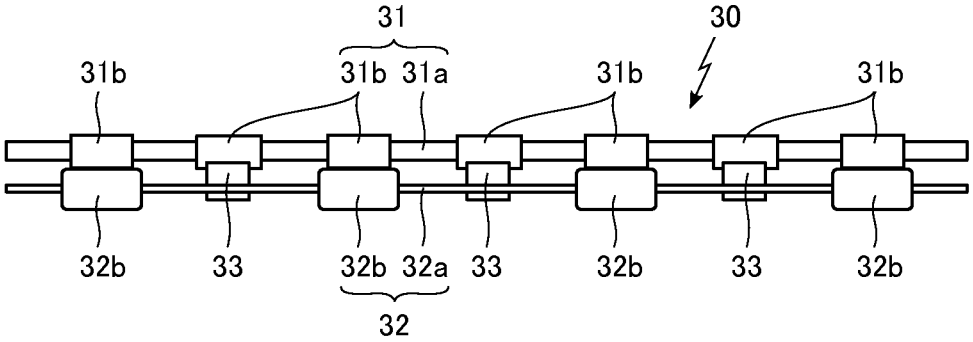
FIG. 3 is a schematic front view of the sheet discharge apparatus according to the above embodiment, showing how the discharge roller, feeding roller and guide are arranged as seen from a sheet discharge side.

In the sheet discharge apparatus 30 according to the embodiment, as shown in FIG. 1 to FIG. 3, a plurality of roller portions 31*b* are arranged on a rotary shaft 31*a* of the discharge roller 31 with a required spacing, while a plurality of roller portions 32*b* are arranged on a rotary shaft 32*a* of a feeding roller 32 with a required spacing or in abutting relation with every other roller portion 31*b* of the discharge roller 31. The discharge roller 31 and the feeding roller 32 are vertically arranged one above the other to allow the roller portions 32*b* of the feeding roller 32 to contact lower sides of the roller portions 31*b* of the discharge roller 31.

Further, a guide 33 that is extended from an upstream side to a downstream side in a discharge direction of the sheet S is provided in correspondence to each of the roller portions 31*b* of the discharge roller 31 that are not in contact with the roller portions 32*b* of the above-described feeding roller 32. This guide 33 has a downstream end in the discharge direction contacted on the roller portion 31*b* of the discharge roller 31 at a downstream position in the discharge direction of the sheet S from the position where the roller portion 32*b* of the feeding roller 32 contacts the roller portion 31*b* of the discharge roller 31. This embodiment employs an elastic sheet material for the guide 33. The guide 33 formed of the elastic sheet material has the downstream end in the discharge direction pressed against the roller portion 31*b* of the discharge roller 31.

Figure 4A:
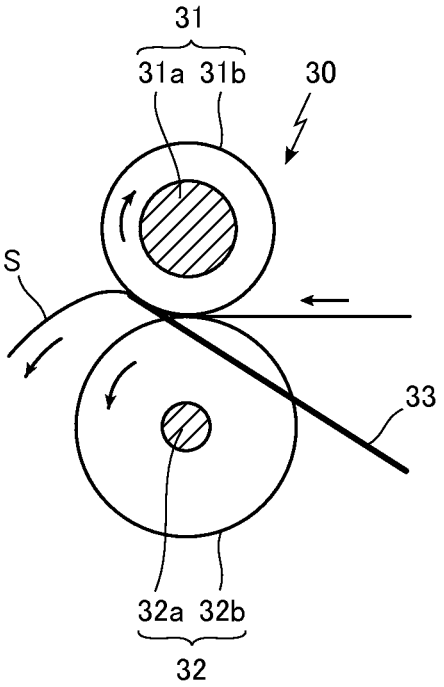
FIG. 4A is a schematic explanatory diagram of the sheet discharge apparatus according to the above embodiment, showing the sheet being discharged through between a roller portion of the discharge roller and the guide.
Figure 4B:
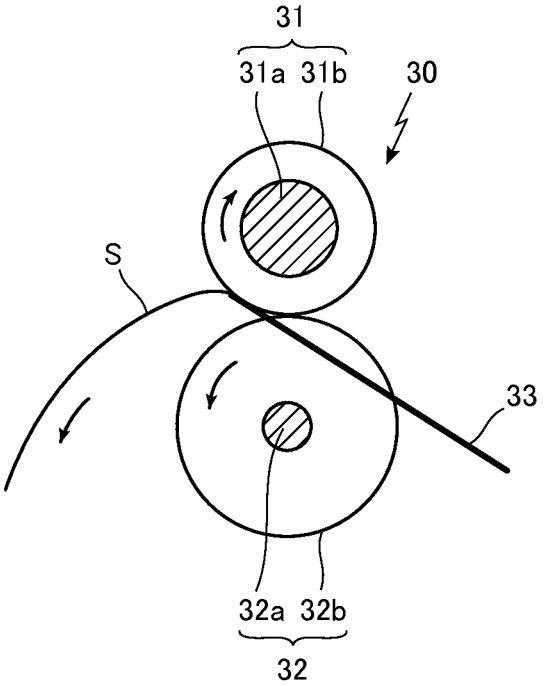
FIG. 4B is a schematic explanatory diagram of the sheet discharge apparatus according to the above embodiment, showing a state where a trailing end of the sheet is discharged through between the roller portion of the discharge roller and the guide.

In this state, as shown in FIG. 4A and FIG. 4B, when the sheet S is fed into nip between the discharge roller 31 and the feeding roller 32 and transported as pinched between the roller portions 31*b* of the rotating discharge roller 31 and the roller portions 32*b* of the feeding roller 32, the sheet S is still transported as pinched between the roller portions 31*b* of the rotating discharge roller 31 and the guide 33 after the trailing end of this sheet S in the discharge direction passes beyond the position where the roller portions 31*b* of the discharge roller 31 contact the roller portions 32*b* of the feeding roller 32. The sheet S is discharged when the trailing end of this sheet S in the discharge direction passes beyond the position where the roller portions 31*b* of the discharge roller 31 contact the guide 33.

Therefore, the trailing end of the sheet S is prevented from remaining on the roller portions 32*b* of the feeding roller 32. Thus, the trailing end of the sheet S is properly discharged through nip between the roller portions 31*b* of the discharge roller 31 and the guide 33 to the sheet delivery portion 3.

Figure 5:
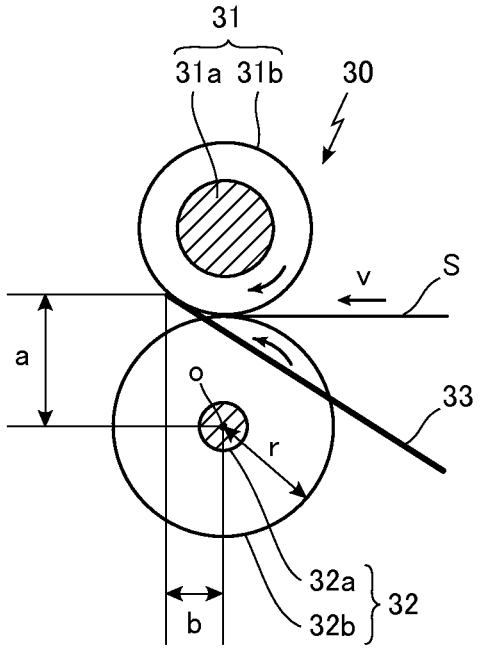
FIG. 5 is a schematic explanatory diagram of the sheet discharge apparatus according to the above embodiment, showing a preferred mode of arrangement of the discharge roller, the feeding roller and the guide.

As described above, the downstream end of the guide 33 in the discharge direction is pressed against the roller portion 31*b* of the discharge roller 31 at the downstream position in the discharge direction of the sheet S from the position where the roller portion 32*b* of the feeding roller 32 contacts the roller portion 31*b* of the discharge roller 31. It is preferred in this arrangement, as shown in FIG. 5, that the horizontal distance 'b' between the position of shaft center 'o' of the feeding roller 32 and the contact position between the guide 33 and the roller portion 31*b* of the discharge roller 31 satisfies the condition:

$$b>r-v\cdot(2a/g)^{1/2},$$

where 'r' denotes the radius of the roller portion 32*b* of the feeding roller 32; 'a' denotes the vertical distance between the position of shaft center 'o' of the feeding roller 32 and the contact position between the guide 33 and the roller portion 31*b* of the discharge roller 31; 'b' denotes the horizontal distance between the position of shaft center 'o' of the feeding roller 32 and the contact position between the guide 33 and the roller portion 31*b* of the discharge roller 31; 'v' denotes the velocity at which the discharge roller 31 discharges the sheet S; and 'g' denotes the acceleration due to gravity.

Namely, time 't' that elapses before the trailing end of the sheet S discharged from the contact position between the guide 33 and the roller portion 31*b* of the discharge roller 31 is allowed to fall freely to the position of shaft center 'o' of the feeding roller 32 is expressed by an equation:

$$t=(2a/g)^{1/2}.$$

The distance 'x' that the sheet S discharged at the sheet discharge velocity 'v' by the discharge roller 31 is horizontally moved during this time period 't' is expressed by an equation:

$$x=v\cdot(2a/g)^{1/2}.$$

If the sum $[b+x=b+v\cdot(2a/g)^{1/2}]$ of the horizontal distance 'b' between the position of shaft center 'o' of the feeding roller 32 and the contact position between the guide 33 and the roller portion 31*b* of the discharge roller 31 and the above-described distance 'x' is greater than the radius 'r' of the roller portion 32*b* of the feeding roller 32 $[b+v\cdot(2a/g)^{1/2}>r]$, namely, if the arrangement is made to satisfy the above-described condition $b>r-v\cdot(2a/g)^{1/2}$, the trailing end of the sheet S discharged from the contact position between the guide 33 and the roller portion 31*b* of the discharge roller 31 is moved beyond the roller portion 32*b* of the feeding roller 32 so as to be allowed to fall freely. Thus, the sheet S is properly discharged to the sheet delivery portion 3 without entailing the problem that the trailing end of the sheet S remains on the roller portion 32*b* of the feeding roller 32.

Figure 6:
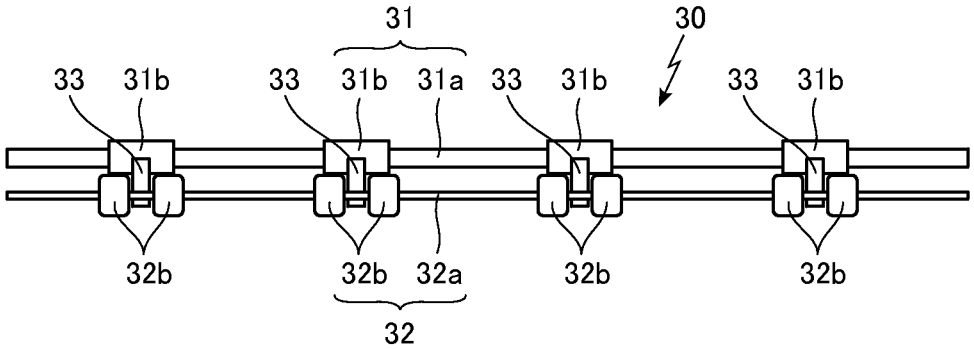
FIG. 6 is a schematic front view of a sheet discharge apparatus according to an exemplary modification of the above embodiment, showing how the discharge roller, the feeding roller and the guide are arranged as seen from the sheet discharge side.

The sheet discharge apparatus 30 according to this embodiment has the arrangement where the roller portion 32*b* of the feeding roller 32 and the guide 33 are arranged to alternately contact the roller portion 31*b* of the discharge roller 31. However, as shown in FIG. 6, an alternative arrangement may also be made such that the roller portion 31*b* of the discharge roller 31 is increased in length so as to allow the roller portions 32*b* of the feeding roller 32 and the guide 33 to contact the same roller portion 31*b* of the discharge roller 31.

Although the present invention has been fully described by way of examples, it is to be noted that various changes and modifications will be apparent to those skilled in the art.

Therefore, unless otherwise such changes and modifications depart from the scope of the invention, they should be construed as being included therein.

The invention claimed is:

1. A sheet discharge apparatus comprising:

a first discharge roller;

a second discharge roller that is arranged to oppose the first discharge roller, wherein the first discharge roller and the second discharge roller are arranged to pinch a sheet therebetween and to discharge the sheet to a sheet delivery portion by rotation; and a guide which is arranged from an upstream side to a downstream side in a discharge direction of the sheet and which contacts the first discharge roller at a position that is downstream in the discharge direction from a position where the first discharge roller contacts the second discharge roller;

wherein the guide is formed of an elastic material, and wherein the first discharge roller is arranged in an upper side of the second discharge roller.

2. The sheet discharge apparatus according to claim 1, wherein a downstream end of the guide in the discharge direction of the sheet is arranged to contact the first discharge roller at the position that is downstream in the discharge direction from the position where the second discharge roller contacts the first discharge roller.

3. The sheet discharge apparatus according to claim 1, wherein the first discharge roller and the second discharge roller are vertically arranged one above the other to allow the second discharge roller to contact a lower side of the first discharge roller, and the guide is arranged to contact the first discharge roller at the position that is downstream in the discharge direction from the position where the second discharge roller contacts the first discharge roller; and wherein a horizontal distance 'b' between a position of a shaft center of the second discharge roller and the contact position between the guide and the first discharge roller satisfies a condition:

$$b>r-v\cdot(2a/g)^{1/2}$$

where

'r' denotes the radius of the second discharge roller;

'a' denotes a vertical distance between the position of the shaft center of the second discharge roller and the contact position between the guide and the first discharge roller;

'v' denotes a velocity at which the first discharge roller discharges the sheet; and 'g' denotes acceleration due to gravity.

4. The sheet discharge apparatus according to claim 1, wherein a plurality of roller portions of the first discharge roller are arranged on a rotary shaft of the first discharge roller with a required spacing, and a plurality of roller portions of the second discharge roller are arranged on a rotary shaft of the second discharge roller with a required spacing, wherein each of a first plurality among the plurality of roller portions of the first discharge roller which contact with the plurality of roller portions of the second discharge roller and each of a second plurality among the plurality of roller portions of the first discharge roller which do not contact with the plurality of roller portions of the second discharge roller, are alternately arranged, and wherein the guide is provided in contact with each of the second plurality of roller portions of the first discharge roller which do not contact the plurality of roller portions of the second discharge roller.

5. The sheet discharge apparatus according to claim 1, wherein a plurality of roller portions of the first discharge roller are arranged on a rotary shaft of the first discharge roller with a required spacing, and a plurality of roller portions of the second discharge roller are arranged on a rotary shaft of the second discharge roller, wherein two roller portions among the plurality of roller portions arranged on the rotary shaft of the second discharge roller are arranged with a given spacing to contact one of the plurality of roller portions of the first discharge roller, and wherein the guide is provided between the two roller portions of the second discharge roller and makes contact with said one of the plurality of roller portions of the first discharge roller.

6. An image forming apparatus comprising a sheet discharge apparatus for discharging a sheet with a toner image formed thereon to a sheet delivery portion, wherein the sheet discharge apparatus comprises:

a first discharge roller;

a second discharge roller that is arranged to oppose the first discharge roller, wherein the first discharge roller and the second discharge roller are arranged to pinch the sheet therebetween and to discharge the sheet to the sheet delivery portion by rotation; and a guide which is arranged from an upstream side to a downstream side in a discharge direction of the sheet and which contacts the first discharge roller at a position that is downstream in the discharge direction from a position where the first discharge roller contacts the second discharge roller;

wherein the guide is formed of an elastic material, and wherein the first discharge roller is arranged in an upper side of the second discharge roller.

7. The image forming apparatus according to claim 6, wherein a downstream end of the guide in the discharge direction of the sheet is arranged to contact the first discharge roller at the position that is downstream in the discharge direction from the position where the second discharge roller contacts the first discharge roller.

8. The image forming apparatus according to claim 6, wherein the first discharge roller and the second discharge roller are vertically arranged one above the other to allow the second discharge roller to contact a lower side of the first discharge roller, and the guide is arranged to contact the first discharge roller at the position that is downstream in the discharge direction from the position where the second discharge roller contacts the first discharge roller; and wherein a horizontal distance 'b' between a position of a shaft center of the second discharge roller and the contact position between the guide and the first discharge roller satisfies a condition:

$$b > r - v \cdot (2a/g)^{1/2}$$

where

'r' denotes the radius of the second discharge roller;

'a' denotes a vertical distance between the position of the shaft center of the second discharge roller and the contact position between the guide and the first discharge roller;

'v' denotes a velocity at which the first discharge roller discharges the sheet; and 'g' denotes acceleration due to gravity.

9. The image forming apparatus according to claim 6, wherein a plurality of roller portions of the first discharge roller are arranged on a rotary shaft of the first discharge roller with a required spacing, and a plurality of roller portions of the second discharge roller are arranged on a rotary shaft of the second discharge roller with a required spacing, wherein each of a first plurality among the plurality of roller portions of the first discharge roller which contact with the plurality of roller portions of the second discharge roller and each of a second plurality among the plurality of roller portions of the first discharge roller which do not contact with the plurality of roller portions of the second discharge roller, are alternately arranged, and wherein the guide is provided in contact with each of the second plurality of roller portions of the first discharge roller which do not contact the plurality of roller portions of the second discharge roller.

10. The image forming apparatus according to claim 6, wherein a plurality of roller portions of the first discharge roller are arranged on a rotary shaft of the first discharge roller with a required spacing, and a plurality of roller portions of the second discharge roller are arranged on a rotary shaft of the second discharge roller, wherein two roller portions among the plurality of roller portions arranged on the rotary shaft of the second discharge roller are arranged with a given spacing to contact one of the plurality of roller portions of the first discharge roller, and wherein the guide is provided between the two roller portions of the second discharge roller and makes contact with said one of the plurality of roller portions of the first discharge roller.

11. A sheet discharge apparatus comprising:

a first discharge roller;

a second discharge roller that is arranged to oppose the first discharge roller, wherein the first discharge roller and the second discharge roller are arranged to pinch a sheet therebetween and to discharge the sheet to a sheet delivery portion by rotation; and a guide which is arranged from an upstream side to a downstream side in a discharge direction of the sheet and which contacts the first discharge roller at a position that is downstream in the discharge direction from a position where the first discharge roller contacts the second discharge roller;

wherein the first discharge roller and the second discharge roller are vertically arranged one above the other to allow the second discharge roller to contact a lower side of the first discharge roller, and the guide is arranged to contact the first discharge roller at the position that is downstream in the discharge direction from the position where the second discharge roller contacts the first discharge roller; and wherein a horizontal distance 'b' between a position of a shaft center of the second discharge roller and the contact position between the guide and the first discharge roller satisfies a condition:

$b > r - v \cdot (2a/g)^{1/2}$, where

'r' denotes a radius of the second discharge roller;

'a' denotes a vertical distance between the position of the shaft center of the second discharge roller and the contact position between the guide and the first discharge roller;

'v' denotes a velocity at which the first discharge roller discharges the sheet; and 'g' denotes acceleration due to gravity.

12. The sheet discharge apparatus according to claim 11, wherein a downstream end of the guide in the discharge direction of the sheet is arranged to contact the first discharge roller at the position that is downstream in the discharge direction from the position where the second discharge roller contacts the first discharge roller.

13. The sheet discharge apparatus according to claim 11, wherein the guide is formed of an elastic material and pressed against the first discharge roller.

14. The sheet discharge apparatus according to claim 11, wherein the sheet is discharged from between the first discharge roller and the second discharge roller to the sheet delivery portion that is disposed outside an image forming apparatus.

15. The sheet discharge apparatus according to claim 11, wherein the sheet with a toner image formed thereon is discharged from between the first discharge roller and the second discharge roller to the sheet delivery portion.

16. An image forming apparatus comprising a sheet discharge apparatus for discharging a sheet with a toner image formed thereon to a sheet delivery portion, wherein the sheet discharge apparatus comprises:

a first discharge roller;

a second discharge roller that is arranged to oppose the first discharge roller, wherein the first discharge roller and the second discharge roller are arranged to pinch the sheet therebetween and to discharge the sheet to the sheet delivery portion by rotation; and a guide which is arranged from an upstream side to a downstream side in a discharge direction of the sheet and which contacts the first discharge roller at a position that is downstream in the discharge direction from a position where the first discharge roller contacts the second discharge roller;

wherein the first discharge roller and the second discharge roller are vertically arranged one above the other to allow the second discharge roller to contact a lower side of the first discharge roller, and the guide is arranged to contact the first discharge roller at the position that is downstream in the discharge direction from the position where the second discharge roller contacts the first discharge roller, and wherein a horizontal distance 'b' between a position of a shaft center of the second discharge roller and the contact position between the guide and the first discharge roller satisfies a condition:

$b > r - v/ \cdot (2a/g)^{1/2}$, where

'r' denotes a radius of the second discharge roller;

'a' denotes a vertical distance between the position of the shaft center of the second discharge roller and the contact position between the guide and the first discharge roller;

'v' denotes a velocity at which the first discharge roller discharges the sheet; and 'g' denotes acceleration due to gravity.

17. The image forming apparatus according to claim 16, wherein a downstream end of the guide in the discharge direction of the sheet is arranged to contact the first discharge roller at the position that is downstream in the discharge direction from the position where the second discharge roller contacts the first discharge roller.

18. The image forming apparatus according to claim 16, wherein the guide is formed of an elastic material and pressed against the first discharge roller.

19. The image forming apparatus according to claim 16, wherein the sheet is discharged from between the first discharge roller and the second discharge roller to the sheet delivery portion that is disposed outside the image forming apparatus.

20. The image forming apparatus according to claim 16, wherein the sheet with the toner image formed thereon is discharged from between the first discharge roller and the second discharge roller to the sheet delivery portion.

* * * * *